US005614262A

United States Patent [19]

Joesten

[11] Patent Number: 5,614,262

[45] Date of Patent: Mar. 25, 1997

[54] METHOD OF SEALING RESIN TO AN ALLOY CASTING

[75] Inventor: Leonard S. Joesten, Rockford, Ill.

[73] Assignee: Sundstrand Corporation, Rockford, Ill.

[21] Appl. No.: 236,619

[22] Filed: May 2, 1994

[51] Int. Cl.[6] ..... B05D 3/06

[52] U.S. Cl. ..... 427/318; 427/386; 427/388.4

[58] Field of Search ..... 427/318, 386, 427/388.4

[56] References Cited

U.S. PATENT DOCUMENTS

| | | | |
|---|---|---|---|
| 3,214,287 | 10/1965 | Mosna | 427/318 |
| 3,546,016 | 12/1970 | Pavelich | 427/318 |
| 4,172,178 | 10/1979 | Gainer | 428/258 |
| 4,536,420 | 8/1985 | Rickert, Jr. | 427/257 |
| 4,772,322 | 9/1988 | Bellis et al. | 75/230 |
| 5,204,385 | 4/1993 | Naderhoff | 523/417 |

OTHER PUBLICATIONS

T 882,017 Jan. 26, 1971 882OG. 1346.

*Primary Examiner*—Sam Silverberg
*Attorney, Agent, or Firm*—Kristin L. Chapman

[57] ABSTRACT

This invention relates to a method of sealing resin to an alloy casting using either an aromatic solvent or an aqueous-based solution. The method includes providing a resin and combining the aromatic solvent with the resin to form a sealing coating which has a predetermined concentration by volume of resin to sealing coating. The method continues by heating the alloy casting to a first predetermined temperature and then selectively applying the sealing coating to the heated alloy casting. Finally the heated alloy casting is baked at a second predetermined temperature for a predetermined time period. Variations of this process using an aqueous-based solution include providing an aqueous-emulsified resin, and then combining the aqueous-emulsified resin with at least one base solvent to form a final aqueous-based solution which has a predetermined concentration by volume of base solvent to final aqueous-based solution. The process allows for the selection of differing materials to be combined.

23 Claims, 3 Drawing Sheets

METHOD OF SEALING RESIN TO AN ALLOY CASTING

TECHNICAL FIELD

This invention relates to a method of sealing resin to an alloy casting using either an aromatic solvent or an aqueous-based solution.

BACKGROUND OF THE INVENTION

Alloy castings, including those made from aluminum, magnesium, and iron, often house aircraft generator components which are subject to stringent design requirements and rigorous environmental operating conditions. In order to provide resistance and prevent corrosion against oil and other solvents inherent with the operation of aircraft generator components, alloy castings are often treated and sealed with an organic coating such as resin. A resin seal provides a physical barrier for the alloy casting against the hot oil and other solvents necessary for the generator components to function effectively.

One procedure for sealing resin to a housing made from a cast alloy material includes dipping the housing in a phenolic resin bath in which an aromatic solvent has been combined with a phenolic resin. After immersion, any excess dripping resin is wiped off before the housing is baked in an oven. During baking, the aromatic solvent evaporates leaving a seal of cured phenolic resin. With such a crude procedure, however, critical dimensions which are crucial to an aircraft generator's performance are difficult to obtain; and, intensive labor is required in attempting to meet such critical dimensions. This added time and effort directly effects the cost associated with manufacturing alloy castings. In addition, this procedure employs the use of aromatic solvents which are known for their environmentally unfriendly impact on the ozone layer, and whose use may soon be severely curtailed by United States governmental regulations.

The desirability of an epoxy resin coating curing agent is addressed in U.S. Pat. No. 5,204,385 to Naderhoff. The Naderhoff patent teaches a water reducible epoxy curing agent which is prepared by first reacting a chemical excess of a polyfunctional epoxide compound with a quaternary ammonium salt, and then, condensing the unreacted epoxide groups of the reaction product with a polyamine. While the Naderhoff patent addresses the particular chemistry of an epoxy resin curing agent, it does not, as the invention to be described more fully hereinafter, detail a method of how to seal resin to an alloy casting, especially in circumstances when dimensions are critical to meet.

A process for producing flat products from particulate material is disclosed in a patent to Bellis et al, U.S. Pat. No. 4,772,322. The process comprises the steps of: forming a relatively smooth cartable slurry, comprising a suspension of particulate material in an aqueous solution, a film-forming binder material and a dispersion of a particulate synthetic resin in an aqueous solution; depositing a coating of this slurry onto a support surface; and heating the deposited coating to a temperature at which a component of the synthetic resin volatilizes. The Belles et al patent, however, does not, as the invention to be described more fully hereinafter, provide a method for sealing resin to an alloy casting; rather, the patent utilizes a resin curing agent to manufacture a product by curing a resin particulate coating on a metallic substrate, and then, specifically separates the shaped coating from the substrate as a flat product. Thus, the Belles et al patent employs the coating as the finished formed product.

A process and composition which produces a permanently water wadable, abrasion-resistant film on a surface is disclosed in a patent to Rickert, Jr., U.S. Pat. No. 4,536,420. In the process, a composition, comprising a mixture of an aqueous colloidal dispersion of carboxylic acid functional polymer, an aqueous colloidal dispersion of surface hydroxylated silica, an amine to render the carboxylic acid functional polymer water soluble, a curing agent for the carboxylic acid functional polymer, and a wetting agent, is applied to a surface to form a film, and the film is dried and/or heated at a temperature sufficient to harden or cure the film. While the Rickert, Jr. patent addresses a process of applying a film to a surface, the chemistry of the composition applied is directed to that of an acrylic resin. The chemistry of such a composition is completely different from an epoxy or phenolic resin which is present with the instant invention. Further, the Rickert, Jr. patent is specifically directed to producing a water wadable surface, while the instant invention is directed to a method of sealing resin to a surface to form a physical barrier between a solvent such as oil and an alloy casting.

The present invention is directed to overcoming one or more of the above problems.

SUMMARY OF THE INVENTION

More specifically, this invention relates to a method of sealing resin to an alloy casting using an aromatic solvent. The method includes providing a resin, and combining the aromatic solvent with the resin to form a sealing coating. The sealing coating has a predetermined concentration by volume of resin. The method also includes heating the alloy casting to a first predetermined temperature, and then selectively applying the sealing coating to the heated alloy casting. Finally, the heated alloy casting applied with the sealing coating is baked at a second predetermined temperature for a predetermined time period.

The invention contemplates in a second preferred embodiment, a method of sealing resin to an alloy casting using an aqueous-based solution. The method includes providing an aqueous-emulsified resin, and combining a base solvent with the aqueous-emulsified resin to form a final aqueous-based solution. The final aqueous-based solution has a predetermined concentration by volume of base solvent. The method also includes heating the alloy casting to a first predetermined temperature, and applying the final aqueous-based solution to the heated alloy casting. Finally, the heated alloy casting applied with the final aqueous-based solution is baked at a second predetermined temperature for a predetermined time period.

The invention also contemplates in a further preferred embodiment, a method of sealing resin to an alloy casting using an aqueous-based solution. The method includes providing an aqueous-emulsified resin, and combining a first base solvent with the aqueous-emulsified resin to form an intermediary solution. The intermediary solution has a first predetermined concentration by volume of first base solvent. The method also includes providing a second base solvent wherein the second base solvent has a second predetermined concentration by ratio of isopropyl alcohol to deionized water. The second base solvent is combined with the intermediary solution to form a final aqueous-based solution. The final aqueous-based solution has a third predetermined concentration by ratio of second base solvent to intermediary solution. The method continues by heating the alloy casting to a first predetermined temperature, and applying the final aqueous-based solution to the heated alloy casting. The heated alloy casting applied with the final aqueous-based solution is baked at a second predetermined temperature for a predetermined time period.

Other objects and advantages of the present invention will be apparent upon the accompanying description when taken in conjunction with the following drawings.

BRIEF DESCRIPTION OF THE DRAWINGS

While the specification concludes with claims particularly pointing out and distinctly claiming that which is regarded as the present invention, the organization, advantages, and further objects of the invention may be readily ascertained by one skilled in the art from the following detailed description when read in conjunction with the accompanying drawings in which:

DESCRIPTION OF THE PREFERRED EMBODIMENT

Figure 1:
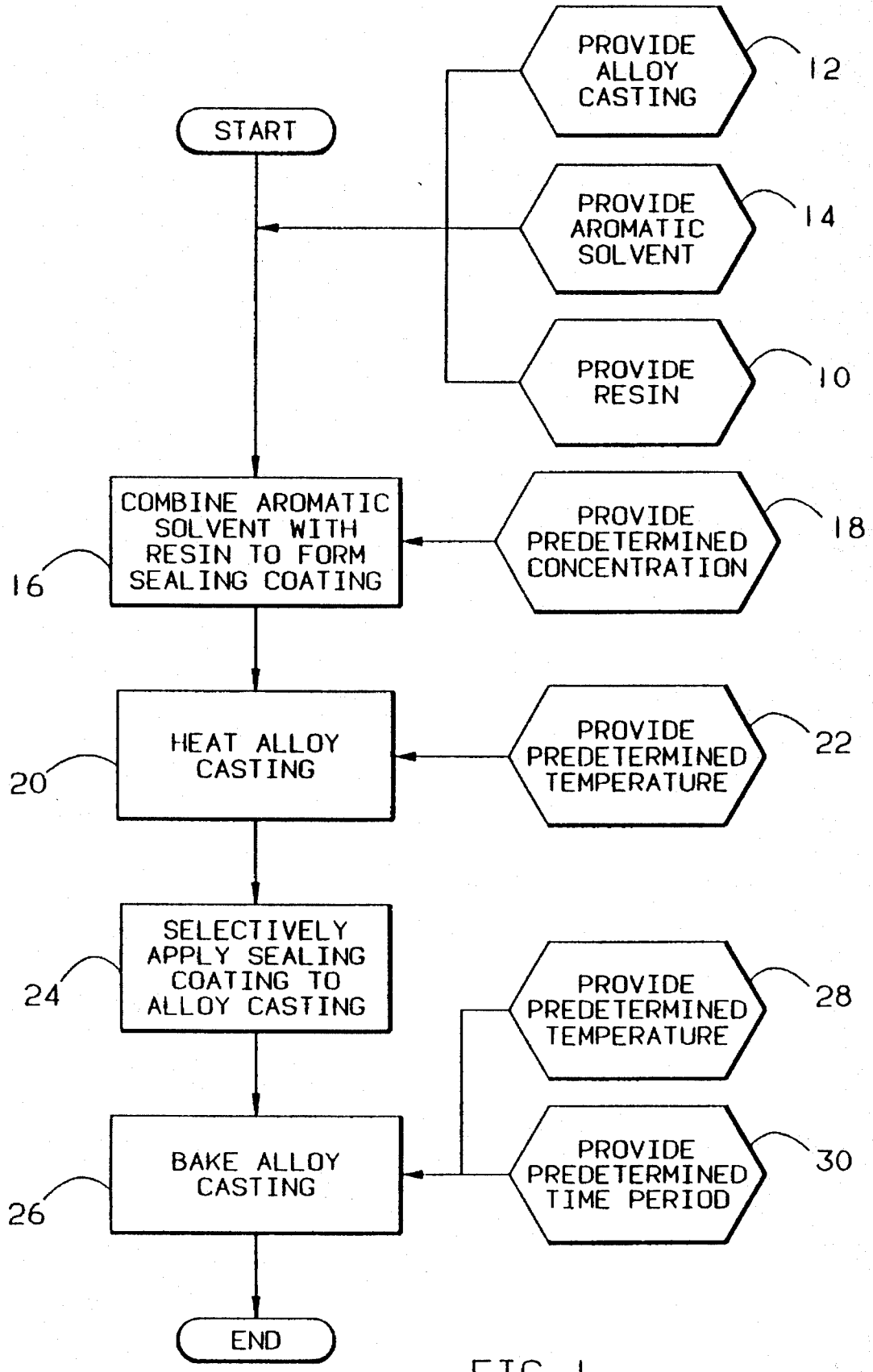
FIG. 1 is a process flow diagram of an embodiment of the instant invention illustrating a method of sealing resin to an alloy casting using an aromatic solvent.

FIG. 1 illustrates a process flow diagram of a method of sealing resin to an alloy casting using an aromatic solvent in accordance with the present invention.

As illustrated in FIG. 1, a first step 10 in one preferred embodiment of the process, comprises providing a resin. The resin may be either of a phenolic or epoxy nature so as to adequately prevent corrosion and provide resistance against oil and other solvents.

An alloy casting is provided in a preparation step 12. The alloy casting may be selected as magnesium, aluminum, or iron; all of which are commonly used to house aircraft generator components by forming a mold out of liquid metal. In a preparation step 14, an aromatic solvent is provided which acts as a carrier for the resin to form a resin seal on the alloy casting by evaporating as the alloy casting is heated. The aromatic solvent may include toluene or xylene.

A second step 16 in the process of the instant invention as illustrated in FIG. 1, comprises combining the aromatic solvent with the resin to form a sealing coating. The sealing coating has a predetermined concentration by volume of resin which is provided in a configuring step 18. In this preferred embodiment, the predetermined concentration of the sealing coating should be provided as not greater than 20% by volume of resin. Thus, if the concentration of resin is provided at 20% by volume, then the concentration of aromatic solvent should be 80% by volume.

A third step 20 in the process of the instant invention, as illustrated in FIG. 1, comprises heating the alloy casting to a first predetermined temperature which is provided in a configuring step 22. In this preferred embodiment, the first predetermined temperature should be provided as not less than 375 degrees Fahrenheit. The configuring step 22 of providing the first predetermined temperature is significant as the resin, combined with the aromatic solvent in the second step 16 to form the sealing coating, will not adhere well to the alloy casting if the alloy casting is not provided at the first predetermined temperature.

A fourth step 24 in the process of the instant invention, as illustrated in FIG. 1, comprises selectively applying the sealing coating formed in the second step 16 to the alloy casting heated in the third step 20. The fourth step 24 of selectively applying the sealing coating may be accomplished by selectively spraying the sealing coating formed in the second step 16. Such selective spraying minimizes the cost associated with manufacturing alloy castings, especially when detailed rework is necessary on alloy castings of magnesium, aluminum or iron. Selectively spraying the sealing coating becomes extremely useful when such rework involves critical dimensions on aircraft generator components, as when a bearing liner needs to be remachined and the dimensions are tightly toleranced. In addition, by heating the alloy casting in the third step 20, unworkable voids are eliminated in the resultant resin seal. Such is not the case when the sealing coating is selectively sprayed on a cold alloy casting.

A fifth step 26 in the process of the instant invention, as illustrated in FIG. 1, comprises baking the heated alloy casting applied with the sealing coating. In this preferred embodiment, a second predetermined temperature at which to bake the heated alloy casting is provided in a configuring step 28, and a predetermined time period over which to bake the heated alloy casting in the fifth step 26 is provided in a configuring step 30. The second predetermined temperature provided in the configuring step 28 should be not less than 300 degrees Fahrenheit. The predetermined time period provided in the configuring step 30 should not be less than one hour. By selecting the variables in the configuring steps 28 and 30, adequate time and temperature allowance is given for the resin to seal to the alloy casting while the aromatic solvent evaporates during baking in the fifth step 26. By invoking the steps 10, 16, 20, 24 and 26 of the instant invention, a process is developed for sealing resin to an alloy casting using an aromatic solvent, whereby critical dimensions may be obtained without intensive laborious effort and additional cost.

Figure 2:
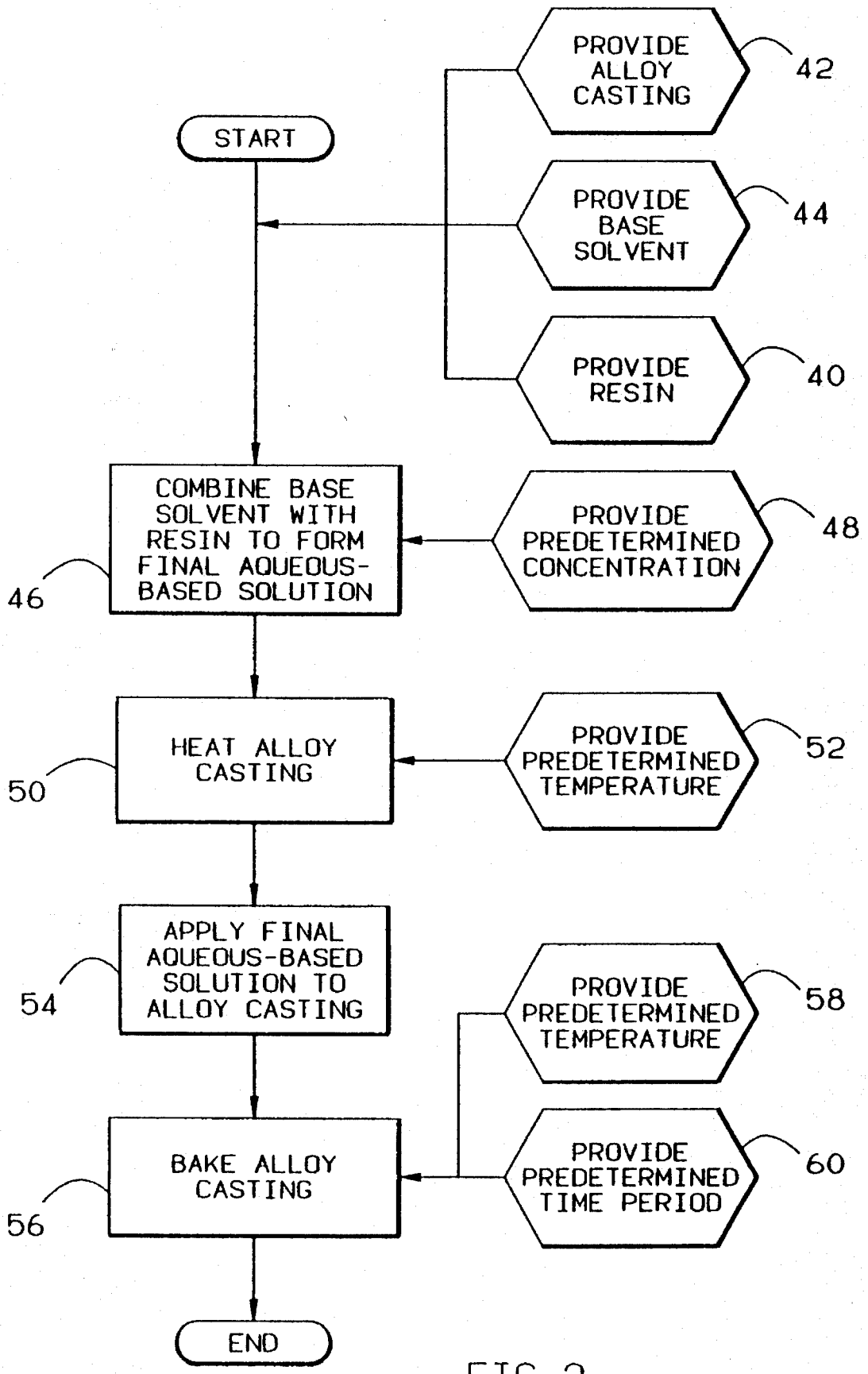
FIG. 2 is a process flow diagram of a second embodiment of the instant invention illustrating a method of sealing resin to an alloy casting using an aqueous-based solution.

FIG. 2 illustrates a process flow diagram of a method of sealing resin to an alloy casting using an aqueous-based solution in accordance with the present invention.

As illustrated in FIG. 2, a first step 40 in a second preferred embodiment of the process, comprises providing an aqueous-emulsified resin. The aqueous-emulsified resin may be either of an aqueous-emulsified phenolic or aqueous-emulsified epoxy nature. The emulsifier present in the resin allows for and promotes the combination of the resin in an aqueous medium; the two of which would not ordinarily combine under natural circumstances.

An alloy casting is provided in a preparation step 42. The alloy casting may be selected as either magnesium, aluminum, or iron; all of which are commonly used to make aircraft generator housings. In a preparation step 44, a base solvent is provided which when combined with any aqueous solution serves to evaporate the aqueous solution at a quicker rate. The base solvent in the instant invention should be an organic solvent and may include isopropyl alcohol or acetone.

A second step 46 in the process of the instant invention as illustrated in FIG. 2, comprises combining the organic base solvent with the aqueous-emulsified resin to form a final aqueous-based solution. The final aqueous-based solution has a predetermined concentration by volume of base solvent which is provided in a configuring step 48. In this preferred embodiment, the predetermined concentration by volume of the final aqueous-based solution should be provided as not greater than 22% by volume of base solvent. Thus, if the concentration of base solvent is provided at 22% by volume, then the concentration of aqueous-emulsified resin should be 78% by volume. By combining the base solvent with the aqueous-emulsified resin in the second step 46, greater surface penetration of the alloy casting may be achieved resulting in a tighter resin seal. This is due to the base solvent, such as isopropyl alcohol, having a low surface tension such that it will flow into irregular areas of the alloy casting.

A third step 50 in the process of the instant invention, as illustrated in FIG. 2, comprises heating the alloy casting to a first predetermined temperature which is provided in a configuring step 52. In this preferred embodiment, the first predetermined temperature should be provided as not less than 375 degrees Fahrenheit. The configuring step 52 of providing the first predetermined temperature is significant as the aqueous-emulsified resin, combined with the base solvent in the second step 46 to form the final aqueous-based solution, will not adhere well to the alloy casting if the alloy casting is not heated to the first predetermined temperature. The adhesive effect is enhanced because the base solvent lowers the temperature at which the aqueous component of the aqueous-emulsified resin evaporates.

A fourth step 54 in the process of the instant invention, as illustrated in FIG. 2, comprises applying the final aqueous-based solution formed in the second step 46 to the alloy casting heated in the third step 50. The fourth step 54 of applying the final aqueous-based solution may be accomplished by immersing the heated alloy casting entirely within the final aqueous-based solution. Such total immersion allows for the ease of manufacturing large quantities of alloy castings, while maintaining the integrity of an environmentally friendly impact by minimizing the use of aromatic solvents.

A fifth step 56 in the process of the instant invention, as illustrated in FIG. 2, comprises baking the heated alloy casting of the third step 50 applied with the final aqueous-based solution of the fourth step 54. In this preferred embodiment, a second predetermined temperature at which to bake the heated alloy casting is provided in a configuring step 58, and a predetermined time period over which to bake the heated alloy casting is provided in a configuring step 60. The predetermined temperature provided in the configuring step 58 should not be less than 300 degrees Fahrenheit. The predetermined time period provided in the configuring step 60 should not be less than one hour. By selecting the variables in the configuring steps 58 and 60, adequate time and temperature allowance is-given for the aqueous-emulsified resin to cure and seal to the alloy casting, while the base solvent evaporates during baking in the fifth step 56. By invoking the steps 40, 46, 50, 54, and 56 of the instant invention, an effective process is developed for sealing resin to an alloy casting while still minimizing the amount of necessary labor involved in the process, and while maintaining an environmentally friendly impact.

Figure 3:
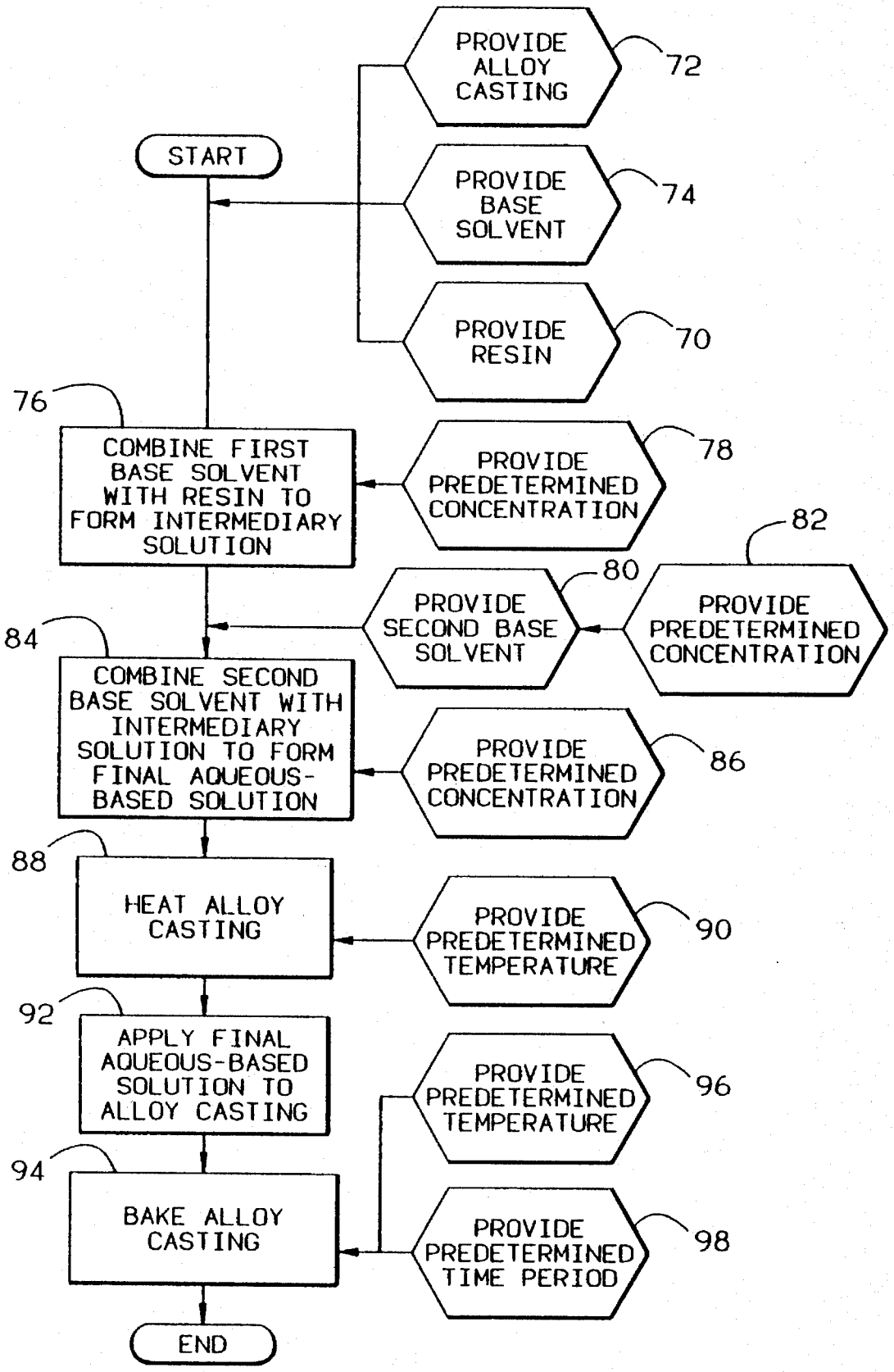
FIG. 3 is a process flow diagram of a further embodiment of the instant invention illustrating a method of sealing resin to an alloy casting using an aqueous-based solution.

FIG. 3 illustrates a process flow diagram for an alternative embodiment of a method of sealing resin to an alloy casting using an aqueous-based solution in accordance with the present invention.

As illustrated in FIG. 3, a first step 70 in a further preferred embodiment of the process, comprises providing an aqueous-emulsified resin. The aqueous-emulsified resin may be either of an aqueous-emulsified phenolic or aqueous-emulsified epoxy nature. The emulsifier present in the resin allows for and promotes the combination of the resin in an aqueous medium; the two of which would not ordinarily combine under natural circumstances.

An alloy casting is provided in a preparation step 72. The alloy casting may be selected as either magnesium, aluminum, or iron; all of which are commonly used to make and house aircraft generator components. In a preparation step 74, a first base solvent is provided which when combined with any aqueous solution serves to evaporate the aqueous solution at a quicker rate. The first base solvent in the instant invention should include an organic solvent such as isopropyl alcohol or acetone. Both of these base solvents possess greater environmentally friendly characteristics over aromatic solvents.

A second step 76 in the process of the instant invention as illustrated in FIG. 3, comprises combining the first base solvent provided in the preparation step 74 with the aqueous-emulsified resin provided in the first step 70 to form an intermediary solution. The intermediary solution has a first predetermined concentration by volume of first base solvent which is provided in a configuring step 78. In this preferred embodiment, the first predetermined concentration by volume of the intermediary solution should be provided as not greater than 22% by volume by first base solvent, such as isopropyl alcohol. Thus, if the concentration of isopropyl alcohol is provided at 22% by volume, then the concentration of aqueous-emulsified resin should be 78% by volume. By combining the first base solvent with the aqueous-emulsified resin in the second step 76, greater surface penetration of the alloy casting may be achieved resulting in a tighter resin seal. This is due to the isopropyl alcohol having a low surface tension such that it will flow into irregular areas of the alloy casting.

A third step 80 in the process of the instant invention, as illustrated in FIG. 3, comprises providing a second base solvent. The second base solvent has a second predetermined concentration by ratio of isopropyl alcohol to deionized water which is provided in a configuring step 82. In this preferred embodiment, the second predetermined concentration by ratio of the second base solvent should be selected as a ratio of about two parts isopropyl alcohol to about seven parts deionized water.

A fourth step 84 in the process in the instant invention, as illustrated in FIG. 3, comprises combining the second base solvent of the third step 80 with the intermediary solution formed in the second step 76 to form a final aqueous-based solution. The final aqueous-based solution has a third predetermined concentration by ratio of second base solvent to intermediary solution which is provided in a configuring step 86. In this preferred embodiment, the third predetermined concentration by ratio of the final aqueous-based solution should be provided as a ratio of about one part second base solvent to about two parts intermediary solution.

A fifth step 88 in the process of the instant invention, as illustrated in FIG. 3, comprises heating an alloy casting to a first predetermined temperature which is provided in a configuring step 90. In this preferred embodiment, the first predetermined temperature should be provided as not less than 375 degrees Fahrenheit. The configuring step 90 of providing the first predetermined temperature is significant as the aqueous-emulsified resin, combined with the first base solvent in the second step 76 to form the intermediary solution, and subsequently combined with the second base solvent in the fourth step 84, will not adhere well to the alloy casting if the alloy casting is not provided at the first predetermined temperature.

A sixth step 92 in the process of the instant invention, as illustrated in FIG. 3, comprises applying the final aqueous-based solution formed in the fourth step 84 to the alloy casting heated in the fifth step 88. The sixth step 92 of applying the final aqueous-based solution may be accomplished by selectively spraying the heated alloy casting with the final aqueous-based solution formed in the fourth step 84. Such selective spraying minimizes the cost associated with the remanufacturing of alloy castings, especially when detailed rework is necessary on magnesium, aluminum, or iron parts. With selective spraying, critical dimensions may be easily obtained while avoiding excess scrap hardware. In addition, by heating the alloy casting in the fifth step 88, unworkable voids are eliminated in the resultant resin seal. This is not the case when the final aqueous-based solution is selectively sprayed on a cold alloy casting.

A seventh step 94 in the process of the instant invention, as illustrated in FIG. 3, comprises baking the heated alloy casting applied with the final aqueous-based solution. In this preferred embodiment a second predetermined temperature at which to bake the heated alloy casting in the seventh step 94 is provided in a configuring step 96, and a predetermined time period over which to bake the heated alloy casting is provided in a configuring step 98. The second predetermined temperature provided in the configuring step 96 should not be less than 300 degrees Fahrenheit. The predetermined time period provided in the configuring step 98 should not be less than one hour. By selecting the variables in the configuring steps 96 and 98, adequate time and temperature allowance is given for the aqueous-emulsified resin to cure and to seal the alloy casting, while the first and second base solvents evaporate during baking in the seventh step 94. By invoking the steps 70, 76, 80, 84, 88, 92 and 94 of the instant invention, an environmentally friendly process is developed for sealing resin to an alloy casting using an aqueous-based solution whereby critical dimensions may be maintained without intensive laborious efforts or excessive additional cost.

Although this invention has been illustrated and described in connection with the particular embodiments illustrated, it will be apparent to those skilled in the art that various changes may be made therein without departing from the spirit of the invention as set forth in the appended claims.

I claim:

1. A method of sealing resin to an alloy casting using an aromatic solvent, comprising the steps of:

providing the alloy casting selected from the group consisting of magnesium, aluminum and iron;

providing the aromatic solvent selected from the group consisting of toluene and xylene;

providing a resin selected from the group consisting of phenolic and epoxy;

combining the aromatic solvent with the resin to form a sealing coating, the sealing coating having a concentration not greater than 20% by volume of resin to sealing coating;

heating the alloy casting to a temperature not less than 375 degrees Fahrenheit;

selectively spraying the sealing coating to the heated alloy casting; and baking the heated alloy casting selectively sprayed with the sealing coating at a temperature not less than 300 degrees Fahrenheit for a time period not less than one hour.

2. The method of claim 1 wherein the step of selectively spraying the sealing coating to the heated alloy casting includes spraying the sealing coating only in a vicinity of a damaged portion of the alloy casting.

3. A method of sealing resin to an alloy casting using an aqueous-based solution, comprising the steps of:

providing an aqueous-emulsified resin selected from the group consisting of aqueous-emulsified phenolic and aqueous-emulsified epoxy;

combining a base solvent with the aqueous-emulsified resin to form a final aqueous-based solution, the final aqueous-based solution having a predetermined concentration by volume of base solvent to final aqueous-based solution;

heating the alloy casting to a first predetermined temperature of not less than 375 degrees Fahrenheit;

applying the final aqueous-based solution to the heated alloy casting; and baking the heated alloy casting applied with the final aqueous-based solution at a second predetermined temperature for a predetermined time period.

4. The method of claim 3 wherein the step of applying the final aqueous-based solution to the heated alloy casting includes immersing the heated alloy casting within the final aqueous-based solution.

5. The method of claim 4 wherein the step of combining the base solvent with the aqueous-emulsified resin includes providing the predetermined concentration by volume of the final aqueous-based solution as not greater than 22% by volume of base solvent to final aqueous-based solution.

6. The method of claim 5 wherein the step of combining the base solvent with the aqueous-emulsified resin includes selecting isopropyl alcohol as the base solvent.

7. The method of claim 4 wherein the step of baking the heated alloy casting applied with the final aqueous-based solution includes providing the second predetermined temperature as not less than 300 degrees Fahrenheit.

8. The method of claim 7 wherein the step of baking the heated alloy casting applied with the final aqueous-based solution includes providing the predetermined time period as not less than one hour.

9. The method of claim 3 further including the step of providing the alloy casting selected from the group consisting of magnesium, aluminum and iron.

10. A method of sealing resin to an alloy casting using an aqueous-based solution, comprising the steps of:

providing the alloy casting selected from the group consisting of magnesium, aluminum and iron;

providing an aqueous-emulsified resin selected from the group consisting of aqueous-emulsified phenolic and aqueous-emulsified epoxy;

combining isopropyl alcohol with the aqueous-emulsified resin to form a final aqueous-based solution, the final aqueous-based solution having a concentration not greater than 22% by volume of isopropyl alcohol to final aqueous-based solution;

heating the alloy casting to a temperature not less than 375 degrees Fahrenheit;

immersing the heated alloy casting within the final aqueous-based solution; and baking the heated alloy casting immersed within the final aqueous-based solution at a temperature not less than 300 degrees Fahrenheit for a time period not less than one hour.

11. A method of sealing resin to an alloy casting using an aqueous-based solution, comprising the steps of:

providing an aqueous-emulsified resin;

combining a first base solvent with the aqueous-emulsified resin to form an intermediary solution, the intermediary solution having a first predetermined concentration by volume of first base solvent to intermediary solution;

providing a second base solvent, the second base solvent having a second predetermined concentration by ratio of isopropyl alcohol to deionized water;

combining the second base solvent with the intermediary solution to form a final aqueous-based solution, the final aqueous-based solution having a third predetermined concentration by ratio of second base solvent to intermediary solution;

heating the alloy casting to a first predetermined temperature;

applying the final aqueous-based solution to the heated alloy casting; and baking the heated alloy casting applied with the final aqueous-based solution at a second predetermined temperature for a predetermined time period.

12. The method of claim 11 wherein the step of applying the final aqueous-based solution to the heated alloy casting includes selectively spraying the heated alloy casting with the final aqueous-based solution.

13. The method of claim 12 wherein the step of combining the first base solvent with the aqueous-emulsified resin includes providing the first predetermined concentration by volume of the intermediary solution as not greater than 22% by volume of first base solvent to intermediary solution.

14. The method of claim 13 wherein the step of combining the first base solvent with the aqueous-emulsified resin includes selecting isopropyl alcohol as the first base solvent.

15. The method of claim 12 wherein the step of providing the second base solvent includes providing the second predetermined concentration of the second base solvent as a ratio of isopropyl alcohol to deionized water of about 2 parts to 7 parts.

16. The method of claim 12 wherein the step of combining the second base solvent with the intermediary solution includes providing the third predetermined concentration of the final aqueous-based solution as a ratio of second base solvent to intermediary solution of about 1 part to 2 parts.

17. The method of claim 12 wherein the step of heating the alloy casting includes providing the first predetermined temperature as not less than 375 degrees Fahrenheit.

18. The method of claim 12 wherein the step of baking the heated alloy casting applied with the final aqueous-based solution includes providing the second predetermined temperature as not less than 300 degrees Fahrenheit.

19. The method of claim 18 wherein the step of baking the heated alloy casting applied with the final aqueous-based solution includes providing the predetermined time period as not less than one hour.

20. The method of claim 11 further including the step of providing the alloy casting selected from the group consisting of magnesium, aluminum and iron.

21. The method of claim 11 wherein the step of providing an aqueous-emulsified resin includes providing the aqueous-emulsified resin selected from the group consisting of aqueous-emulsified phenolic and aqueous-emulsified epoxy.

22. A method of sealing resin to an alloy casting using an aqueous-based solution, comprising the steps of:

providing the alloy casting selected from the group consisting of magnesium, aluminum and iron;

providing an aqueous-emulsified resin selected from the group consisting of aqueous-emulsified phenolic and aqueous-emulsified epoxy;

combining isopropyl alcohol with the aqueous-emulsified resin to form an intermediary solution, the intermediary solution having a concentration not greater than 22% by volume of isopropyl alcohol to intermediary solution;

providing a second base solvent, the second base solvent having a concentration by ratio of isopropyl alcohol to deionized water of about 2 parts to 7 parts;

combining the second base solvent with the intermediary solution to form a final aqueous-based solution, the final aqueous-based solution having a concentration by ratio of second base solvent to intermediary solution of about 1 part to 2 parts;

heating the alloy casting to a temperature not less than 375 degrees Fahrenheit;

selectively spraying the heated alloy casting with the final aqueous-based solution; and baking the heated alloy casting selectively sprayed with the final aqueous-based solution at a temperature not less than 300 degrees Fahrenheit for a time period not less than one hour.

23. The method of claim 12 wherein the step of selectively spraying the heated alloy casting with the final aqueous-based solution includes spraying the final aqueous-based solution only in a vicinity of a damaged portion of the alloy casting.

* * * * *